United States Patent [19]

Larson

[11] 4,405,389

[45] Sep. 20, 1983

[54] AUSTENITIC STAINLESS STEEL CASTING ALLOY FOR CORROSIVE APPLICATIONS

[75] Inventor: John A. Larson, Easton, Pa.

[73] Assignee: Ingersoll-Rand Company, Woodcliff Lake, N.J.

[21] Appl. No.: 435,699

[22] Filed: Oct. 21, 1982

[51] Int. Cl.[3] ..... C22C 38/44

[52] U.S. Cl. ..... 148/37; 75/128 N; 75/128 V; 75/128 W

[58] Field of Search ..... 148/37; 75/128 R, 128 N, 75/128 V, 128 W

[56] References Cited

U.S. PATENT DOCUMENTS 4,101,347 7/1978 Fujikura et al. ..... 148/37

4,272,305 6/1981 Weingerl et al. ..... 148/37

FOREIGN PATENT DOCUMENTS 55-158256 12/1980 Japan ..... 148/37

*Primary Examiner*—L. Dewayne Rutledge

*Assistant Examiner*—Debbie Yee

*Attorney, Agent, or Firm*—Walter C. Vliet

[57] ABSTRACT

An austenitic stainless steel casting alloy which exhibits superior corrosion resistance. The alloy contains a nominal 10 percent ferrite which exhibits an extremely high level of pitting and crevice corrosion resistance resulting from nitrogen additions in a proper combination of nominal 21 percent chromium, 12 percent nickel, 4 percent molybdenum and manganese content below 0.5 percent. To provide a required degree of solubility of nitrogen and to tie up the carbon, a nominal 0.15 percent of vanadium is added.

6 Claims, 1 Drawing Figure

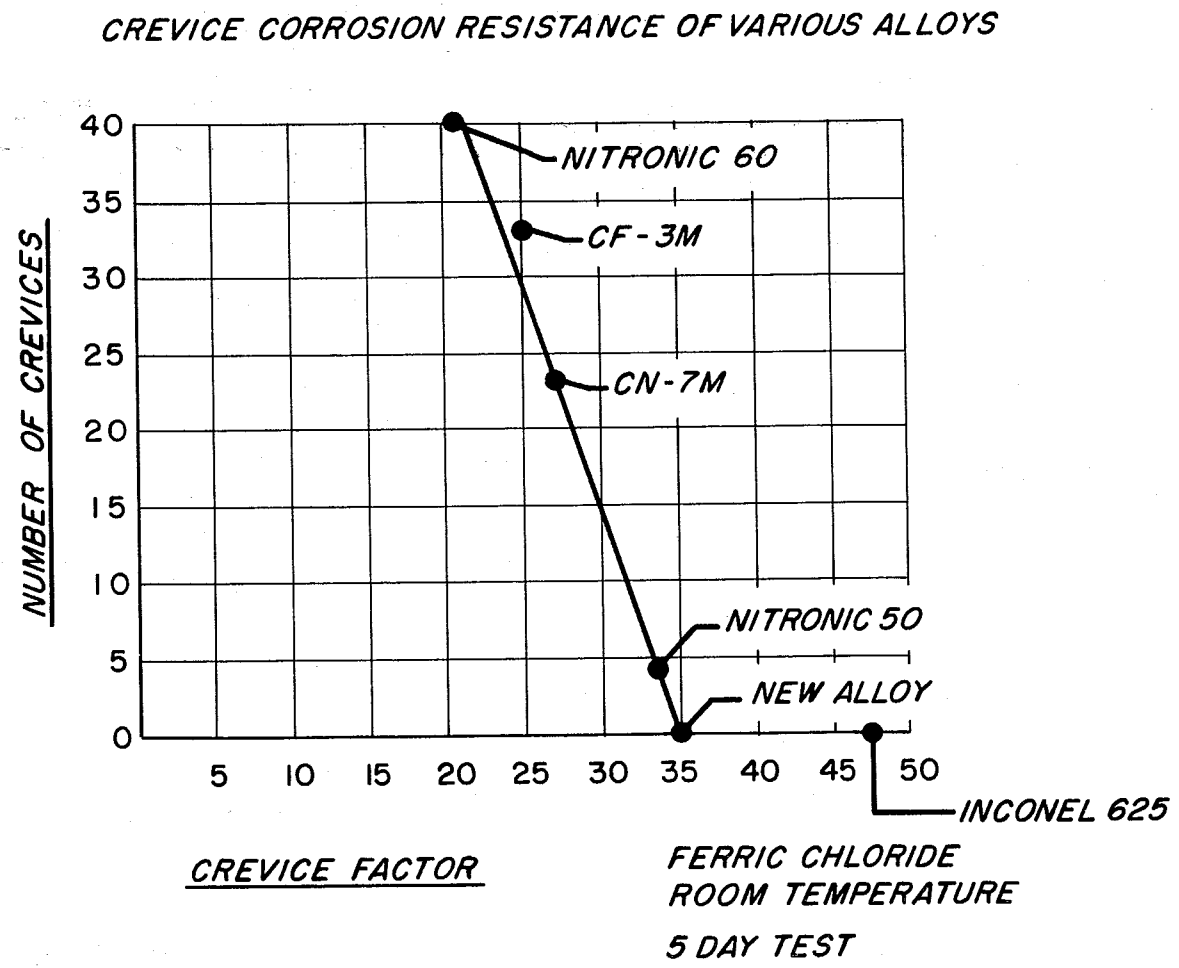
CREVICE CORROSION RESISTANCE OF VARIOUS ALLOYS
NITRONIC 60
CF-3M
CN-7M
NITRONIC 50
NEW ALLOY
INCONEL 625
NUMBER OF CREVICES
0
5
10
15
20
25
30
35
40
CREVICE FACTOR
5
10
15
20
25
30
35
40
45
50
FERRIC CHLORIDE
ROOM TEMPERATURE
5 DAY TEST

AUSTENITIC STAINLESS STEEL CASTING ALLOY FOR CORROSIVE APPLICATIONS

BACKGROUND OF THE INVENTION

The classical American Casting Institute's stainless steel casting alloy, ACI CF-3M, is widely used for pump casings and impellers where a high degree of corrosion resistance is required. Although it is used in seawater which contains a high level of chlorides, it is known that the standard composition is susceptible to localized corrosion in the form of pitting and crevice corrosion and can be susceptible to stress corrosion cracking at temperatures over 160°-180° F. (71° C. to 82° C.). Although the beneficial effects of chromium and molybdenum on the localized corrosion resistance are well known, the effects of nitrogen and particularly the effects of the combination of chromium, nitrogen, and molybdenum have not been established.

BRIEF DESCRIPTION OF THE DRAWINGS

FIG. 1 shows a comparison of the crevice corrosion resistance of the new alloy according to this invention with several other commercially available alloys.

DESCRIPTION OF THE PREFERRED EMBODIMENT

Although some studies with wrought products have shown the effect of molybdenum, the effect of nitrogen, the effect of chromium and in some cases the effect of all three elements on the localized corrosion resistance of austenitic stainless steels, none show the effect of these three elements in combination with low manganese content.

The proper combination of nitrogen, chromium, and molybdenum with reduced manganese produces an unexpected synergistic effect on the pitting and crevice corrosion resistance. This invention describes a cast austenitic alloy containing a nominal 10% ferrite as a second phase, which exhibits an extremely high level of pitting and crevice corrosion resistance, which is due to the synergistic effect of the proper combination of chromium, molybdenum, nitrogen, and manganese.

The corrosion-resistant alloy according to this invention contains a nominal 21% chromium, 12% nickel, and 4% molybdenum, in combination with a nominal 0.15% nitrogen and low manganese (less than 0.5%) to produce a casting alloy having exceptional pitting and crevice corrosion resistance. To provide for the required degree of solubility of nitrogen and to tie up the carbon, a nominal 0.15% vanadium is added.

With a wrought product, the chemistry is adjusted with a diagram such as the Schaeffler diagram to produce a wholly austenitic structure. This is due to the detrimental effect which ferrite has on the workability (formability) of the austenitic steels. In the case of a casting alloy, it is possible to extend the range of chrome, molybdenum, and nitrogen and to keep the nickel low and reduce the manganese to produce a structure containing austenite and ferrite. However for castings, an element such as vanadium or niobium must be added to increase the solubility of nitrogen so that the nitrogen does not come out of solution and produce porosity.

It has been experimentally established that the crevice corrosion resistance is a function primarily of chromium, molybdenum and nitrogen, with the weighting factors referred to chromium as follows:

Crevice Factor = %Cr + 3(%molybdenum) + 15(%nitrogen)

For immunity at room temperature, the Crevice Factor should be equal to or greater than 35.

This factor is valid for a chromium content from 18-23%, a molybdenum content from 2-4.5%, and a nitrogen content from 0.04-0.3%.

The reduced manganese content directly affects the pitting resistance by changing the manganese sulfide inclusions, which can form active pits to chrome sulfide inclusions, which do not pit.

From large, experimental pump castings, it has been found that with the alloys given by this composition, nitrogen contents greater than about 0.2% will result in gas porosity unless an element such as vanadium or niobium is added to increase the nitrogen solubility.

Chemistry:

The chemical composition of the new alloy according to the present invention has an anticipated range of the following percentages of critical elements:

| | C | Mn | Si | Ni | Cr | Mo | N | V | P | S |
|---|---|---|---|---|---|---|---|---|---|---|
| % min. | | 0.1 | 0.2 | 10.0 | 20.0 | 3.2 | 0.10 | 0.10 | | |
| % max. | 0.03 | 0.5 | 2.0 | 14.0 | 23.0 | 4.5 | 0.30 | 0.30 | 0.04 | 0.04 |

The alloy has a preferred range of critical elements of:

| | C | Mn | Si | Ni | Cr | Mo | N | V | P | S |
|---|---|---|---|---|---|---|---|---|---|---|
| % min. | | 0.2 | 0.5 | 11.0 | 20.5 | 3.4 | 0.10 | 0.10 | | |
| % max. | 0.03 | 0.5 | 1.0 | 13.0 | 22.5 | 4.2 | 0.20 | 0.20 | 0.02 | 0.02 |

The alloy has a specific composition of critical elements as follows:

| C | Mn | Si | Ni | Cr | Mo | N | V | P | S |
|---|---|---|---|---|---|---|---|---|---|
| 0.02 | 0.4 | 0.75 | 12.0 | 21.0 | 4.0 | 0.15 | 0.15 | 0.02 | 0.02 |

By way of comparison, the American Casting Institute's stainless steel casting alloy has the following chemistry:

| | CF-3M | | | | | | | | | |
|---|---|---|---|---|---|---|---|---|---|---|
| | C | Mn | Si | Ni | Cr | Mo | N | V | P | S |
| % min. | | | | 9.0 | 17.0 | 2.0 | | | | |
| % max. | 0.03 | 1.50 | 1.50 | 13.0 | 21.0 | 3.0 | | | 0.04 | 0.04 |

In all the above chemical compositions, the balance of the material is iron.

Heat Treatment

The new alloy having the prescribed chemical composition according to this invention requires the following heat treatment to obtain the desired properties:

Anticipated Range of Heat Treatment

Solution anneal at 2050° to 2150° F. (1121° C. to 1177° C.) for 1 hour per inch of thickness followed by a liquid quench.

Specific Recommendation of Heat Treatment

Solution anneal at 2050° F. (1121° C.) for 1 hour per inch of thickness followed by a water quench.

CF-3M is usually produced with about 10–15% ferrite. The primary reason for the ferrite is to improve castability and weldability. The ferrite does provide additional benefits such as higher strength and better stress corrosion resistance. However, these are not the primary reasons for its existence. When a wrought product such as 316L is made (this is the wrought equivalent of CF-3M), the chemistry is chosen to avoid ferrite due to the detrimental effects it has on workability.

If one were to attempt to put additional Cr and/or Mo into CF-3M without a compensating addition of an austenite former, the ferrite content would get too high. In addition, a detrimental phase, called sigma (a Ni-Cr-Mo phase), would start to form. One could, of course, increase the nickel content to compensate for the increased Cr and Mo, but this is an expensive alloying element and would increase the tendency to form sigma and would not increase the crevice corrosion resistance nor the strength. The addition of nitrogen is a much better way to go as an austenite former because it is the most potent element to increase the crevice corrosion resistance. In addition, it retards the formation of sigma, is a very potent element to retard sensitization (the formation of chrome carbides), has a dramatic effect on increasing the strength and is very inexpensive.

Since the wrought product, 316L, does not contain any ferrite, one cannot put as much Cr and Mo into the alloy as can be done with a casting alloy. One could, of course, put nitrogen into 316L, but with a given nitrogen content, one could never put as much Cr and Mo as one can with a casting alloy which contains ferrite.

In essence, the new alloy is a balanced alloy which contains the maximum amount of those elements which improve the crevice corrosion resistance.

Mechanical Properties:

The mechanical properties of the new alloy are shown in Table 1. As can be seen, the mechanical properties of the new alloy are superior to the classical alloy, CF-3M, particularly the proportional limit, which governs many design properties. The cavitation resistance, which is important for pump impellers, is more than twice as great as the classical alloy, CF-3M. This increased resistance is due to the much higher yield strength.

TABLE 1

Comparison of Mechanical Properties of ACI CF-3M and the Alloy Described in this Invention

| Property | CF-3M (typical) | New Alloy (typical) |
|---|---|---|
| Ultimate Tensile Strength - psi | 76,000 | 84,000 |
| 0.2% Yield Strength - psi | 30,000 | 44,000 |
| Proportional Limit - psi | 19,000 | 30,000 |
| Elongation - percent | 52 | 50 |
| Hardness - Brinell | 150 | 183 |
| Cavitation Resistance* | | |
| Normalized to CF-3M | 1.0 | 2.2 |

*Results from vibratory cavitation tests

Crevice Corrosion Resistance:

FIG. 1 shows the results of a five-day crevice corrosion test using a standard multiple crevice corrosion assembly for several commercial stainless steels, the alloy described in this invention, and a control sample of Inconel 625, which is a nickel base alloy. ASTM Standard Procedures G46 and G48 were used for these tests. This graph shows that the new alloy described in this invention is immune to crevice corrosion at room temperature and that the crevice factor, which is given by the following formula, $$\text{Crevice Factor} = \text{Wt\%Cr} + 3(\text{wt\%Mo}) + 15(\text{wt\%(N)})$$

must be equal to or greater than 35 to provide immunity. The fact that all of the different alloys fall on the same curve, even though some contain more alloying elements, shows that this factor with the experimentally determined weighting factor does correctly describe those elements which significantly contribute to crevice corrosion resistance.

Cavitation Resistance:

These are the actual cavitation results comparing CF-3M and the new alloy. The results are as follows:

| Alloy | Cavitation Results: Maximum Mean Depth Of Penetration Rate mils/min. (MDPR max.) | Cavitation Results: Total Weight Loss in 6 Hours |
|---|---|---|
| CF-3M | 0.0065 | 0.0893 grams |
| New Alloy | 0.0029 | 0.0396 grams |

Although the ratio between CF-3M and the new alloy is the same whether one uses MDPR max. or total weight loss, the usual practice is to use MDPR max. for comparisons. The reasons for this are that one must stipulate a time period is one uses weight loss and not all materials have the same density.

Stress Corrosion Resistance:

Table 2 gives the results of laboratory tests used to evaluate the stress corrosion resistance of the new alloy. These tests were conducted in boiling 20% by weight of $CaCl_2$, at a temperature of 215° F. (102° C.). The specimen configuration, consisting of U-bend samples, followed ASTM G30. The specimen size was 120 mm×20 mm×1.5 mm which was bent into a 16 mm radius. To provide for a suitable corrosive environment, the pH was adjusted to 2.0 by using dilute 1:20 hydrochloric acid. For a comparison with commonly used stainless steels, samples of wrought AISI 304 and 316 steels were used, as well as CF-3M, which is the baseline to be used for comparison purposes. In addition, for comparison purposes, a so-called "super" stainless steel containing 25% nickel, 20% chrome, and 5.5% molybdenum, which is known to have very good stress corrosion resistance, was also included in the test. As can be seen, the test results show that the alloy described in this invention has superior stress corrosion resistance compared to the classical ACI alloy CF-3M, as well as to the wrought products AISI 304 and 316. Since AISI 304 contains no molybdenum, it should be the most susceptible to stress corrosion, and as can be seen, it failed in 6 days. AISI 316 contains molybdenum and should therefore have better stress corrosion resistance than 304. However, it has no ferrite in contrast to its cast counterpart, CF-3M, which contains 10–15% ferrite. Since it is well known that ferrite improves the stress corrosion resistance, AISI 316 should fail at a time period between AISI 304 and ACI CF-3M. As can be seen, AISI 316 failed after 33 days, whereas ACI CF-3M failed after 45 days. Since neither the alloy described in this invention nor the super stainless steel suffered any attack after 60 days, it is not known how long they will last. However, this is not unusual for stress corrosion tests and it is common practice to terminate these types of tests after a given period of time, often 60–90 days. Regardless of when the test is terminated, the results show conclusively that the alloy described in this invention has superior stress corrosion resistance compared to the classical ACI alloy CF-3M. This improvement is directly related to the balanced composition, which prevents the initiation of cracks.

TABLE II

Stress Corrosion Test Results
Boiling 20% $CaCl_2$; pH = 2; Temperature = 215° F. (102° C.); U-Bend Samples

| Material | Test Results |
|---|---|
| AISI 304 | Cracks started within 24 hours. Sample lost tension (failed) in six days. |
| AISI 316 | Cracks started after 3 days. Sample lost tension (failed) in 33 days. |
| ACI CF-3M | Cracks appeared after 3 days. Sample lost tension (failed) in 45 days. |
| New Alloy "Super Stainless" Steel 25% Nickel 20% Chromium 5.5% Molybdenum | No attack after 60 days. No attack after 60 days. |

I claim:

1. An austenitic stainless steel casting alloy having approximately 10–15 percent ferrite consisting of the following anticipated range of critical elements:

| | C | Mn | Si | Ni | Cr | Mo | N | V | P | S |
|---|---|---|---|---|---|---|---|---|---|---|
| % min. | | 0.1 | 0.2 | 10.0 | 20.0 | 3.2 | 0.10 | 0.10 | | |
| % max. | 0.03 | 0.5 | 2.0 | 14.0 | 23.0 | 4.5 | 0.30 | 0.30 | 0.04 | 0.04 |

the balance of the material consisting essentially of iron.

2. A casting alloy according to claim 1 having been heat treated as follows:

solution annealed at 2050° F. to 2150° F. (1121° C. to 1177° C.) for one hour per inch of thickness followed by a liquid quench.

3. An austenitic stainless steel casting alloy having approximately 10–15 percent ferrite consisting of the following preferred range of critical elements:

| | C | Mn | Si | Ni | Cr | Mo | N | V | P | S |
|---|---|---|---|---|---|---|---|---|---|---|
| % min. | | 0.2 | 0.5 | 11.0 | 20.5 | 3.4 | 0.10 | 0.10 | | |
| % max. | 0.03 | 0.5 | 1.0 | 13.0 | 22.5 | 4.2 | 0.20 | 0.20 | 0.02 | 0.02 |

the balance of the material consisting essentially of iron.

4. A casting alloy according to claim 3 having been heat treated as follows:

solution annealed at 2050° F. to 2150° F. (1121° C. to 1177° C.) for one hour per inch of thickness followed by a liquid quench.

5. An austenitic stainless steel casting alloy having approximately 10 percent ferrite consisting of the following composition of critical elements:

| C | Mn | Si | Ni | Cr | Mo | N | V | P | S |
|---|---|---|---|---|---|---|---|---|---|
| 0.02 | 0.4 | 0.75 | 12.0 | 21.0 | 4.0 | 0.15 | 0.15 | 0.02 | 0.02 |

the balance of the material consisting of iron.

6. A casting alloy according to claim 5 having been subjected to the following heat treatment:

solution anneal at 2050° F. for one hour per inch of thickness followed by a water quench.

* * * * *